US007982686B2

(12) United States Patent
Cahill et al.

(10) Patent No.: US 7,982,686 B2
(45) Date of Patent: Jul. 19, 2011

(54) FREQUENCY SELECTIVE SURFACES

(75) Inventors: Robert Cahill, Jordanstown (GB); Raymond John Dickie, Belfast (GB); Vincent Francis Fusco, Glengormley (GB); Harold Samuel Gamble, Co Down (IE)

(73) Assignee: The Queen's University of Belfast, Belfast (GB)

( * ) Notice: Subject to any disclaimer, the term of this patent is extended or adjusted under 35 U.S.C. 154(b) by 888 days.

(21) Appl. No.: 11/908,678

(22) PCT Filed: Mar. 16, 2006

(86) PCT No.: PCT/GB2006/000950

§ 371 (c)(1),
(2), (4) Date: Sep. 14, 2007

(87) PCT Pub. No.: WO2006/097736

PCT Pub. Date: Sep. 21, 2006

(65) Prior Publication Data

US 2008/0204355 A1 Aug. 28, 2008

(30) Foreign Application Priority Data

Mar. 16, 2005 (GB) ..... 0505347.5

(51) Int. Cl.
*H01Q 15/02* (2006.01)

(52) U.S. Cl. ..... 343/909

(58) Field of Classification Search ..... 343/909, 343/767, 769, 770, 700 MS, 756; 29/600; 438/723

See application file for complete search history.

(56) References Cited

U.S. PATENT DOCUMENTS 5,633,209 A * 5/1997 Leedy ..... 216/2

OTHER PUBLICATIONS

International Search Report, from PCT/GB2006/000950, mailed Jun. 7, 2006.

A. E. Martynyuk, et al., "Reflective Antenna Arrays Based on Shorted Ring Slots", IEE MTT-S Digest, pp. 1379-1382 (2001).

R. Dickie, et al., "Micromachined 300 GHz high Q resonant slot frequency selective surface filter", IEE Proc.-Microw. Antennas Propag., vol. 151, No. 1, pp. 31-36, (Feb. 2004).

A. E. Martynyuk, et al., "Frequency-selective surfaces based on shorted ring slots", Electronics Letters, vol. 37, No. 5, pp. 1-2, (Mar. 1, 2001).

N. Misran, et al., "Concentric split ring element for dual frequency reflectarray antennas", Electronics Letters, vol. 39, No. 25, pp. 1-2, (Dec. 11, 2003).

J. Shaker, et al., "Analysis of Multiresonant Frequency Selective Surfaces", University of Manitoba, Department of Electrical & Computer Engineering, Winnipeg, Manitoba, Canada R3T 2N2, pp. 1948-1951, (1993).

"International Preliminary Report on Patentability", PCT/GB2006/000950, Sep. 18, 2007.

* cited by examiner

*Primary Examiner* — Jacob Y Choi
*Assistant Examiner* — Robert Karacsony
(74) *Attorney, Agent, or Firm* — Foley & Lardner LLP

(57) ABSTRACT

A freestanding frequency selective surface (FSS) is provided which comprises at least one shorted resonance aperture element (12). The shorted resonance aperture element provides a sensitivity to polarization. The shorted resonance aperture element may comprise at least one short, which may enable the FSS to be freestanding. The invention further provides an FSS device comprising at least one array of the freestanding frequency selective surfaces, and a method of forming the freestanding frequency selective surfaces.

28 Claims, 8 Drawing Sheets

Fabrication Approach 1

1. Fabricate or purchase the 5 - 10μm SOI wafer

2. Trench the silicon to form tiles

3. Spin on 8μm of polyimide

4. Etch the FSS element shape through polyimide and silicon

5. Etch underneath the array to form the freestanding FSS

6. Metallise the array

FREQUENCY SELECTIVE SURFACES

The present invention is related to improvements in or relating to Frequency Selective Surfaces (FSSs), and in particular a frequency selective surface for separating or combining two channels of electromagnetic radiation; to a device incorporating the frequency selective surface, and a method for the production of the frequency selective surface.

The channels of electromagnetic radiation can be linearly, elliptically or circularly polarized, and the invention is particularly applicable for beamsplitting devices that operate at millimeter and sub millimeter wavelengths (i.e. with frequencies from around 100 GHz and upwards).

An FSS functions as shown in FIG. 1. FIG. 1*a* is a view showing incident, reflected and transmitted beams on an FSS 1, orientated at 45° to the incident beam. The incident beam 2, having spot frequencies F1 and F2, is separated into a reflected beam 3, having the spot frequency F1, and a transmitted beam 4, having the spot frequency F2. FIG. 1*b* shows the bandpass frequency response of the FSS 1. The FSS 1 can be used in a reflector antenna, either as a dichroic subreflector or as a waveguide beamsplitter to allow the antenna to operate at two separate frequency bands. Another option is to use the FSS beamsplitter in the quasi-optical feed train of a multi channel radiometer, to separate the energy by frequency and direct the energy to the spatial location of the individual detectors. The FSS 1 can be used singly or cascaded.

An FSS comprises at least one resonant element, the shape of which is designed to produce desired electrical characteristics. The resonant elements are generally formed by printing onto a substrate, to form patches or apertures. The formed resonant elements, or "slots", can take one of many shapes, for example a simple rectangle, a square, an annulus, or a Jerusalem cross shape.

In the case of an annular slot, it is known that splitting the annular slots modifies the electromagnetic behavior of the resonant structure, so that the transmission response is very different for two waves which are orthogonally orientated (TE and TM plane polarized waves).

However, for slots which are formed on a substrate, there will always be dielectric losses, which detract from the beamsplitting efficiency of the device.

According to a first aspect of the present invention there is provided a freestanding frequency selective surface (FSS) comprising at least one shorted resonance aperture element.

The shorted resonance aperture element may provide a sensitivity to polarization.

The at least one shorted resonance aperture element may comprise at least one short, which may enable the FSS to be freestanding.

By a "freestanding" FSS we mean that the resonance element does not have to be supported on a substrate in use, i.e. it is surrounded by the atmosphere in which a device incorporating the FSS is used.

Optionally, the FSS comprises a plurality of nested resonance aperture elements, at least some of which are shorted.

The plurality of nested resonance aperture elements may separate or combine two channels of incident radiation which are very closely spaced in the frequency domain. This results because when two resonance aperture elements are nested, the roll-off response of a first aperture element is increased significantly when compared to the case where the first aperture element is used on its own. This is because the second aperture element resonates in the same mode as the first aperture element, but at a higher frequency.

Optionally, the or at least some of the shorted resonance aperture elements are substantially circular.

Optionally, the or at least some of the circular shorted resonance aperture elements comprise a single short in the circle.

Optionally, the or at least some of the shorted resonance aperture elements have a composite structure, and comprise a stiffener layer bounded on at least one surface thereof by a polymer layer.

The stiffener layer and the polymer layer may be encapsulated by a metallization layer.

Optionally, the stiffener layer is formed from a semiconductor material.

The FSS is thus dimensionally stable under thermal variation due to the lower coefficient of thermal expansion of the stiffener layer compared to the high coefficient of thermal expansion (CTE) of metals or flexible polymers used, and further is more robust than an FSS comprised of metal or polymer alone.

Optionally, the stiffener layer comprises silicon.

Optionally, the stiffener layer is bounded on both a first surface and a second surface thereof by a polymer layer.

Optionally, the or each polymer layer comprises polyimide or B-staged bisbenzocyclobutene (BCB).

According to a second aspect of the present invention there is provided an FSS device comprising at least one array of freestanding frequency selective surfaces according to the first aspect of the invention.

Optionally, a plurality of arrays is provided as one or more spaced layers.

Optionally, the FSS device comprises a tiled structure having a plurality of isolated silicon tiles, at least some of the tiles having at least one FSS shorted resonance aperture element formed therein.

The tiled structure may prevent propagation of cracks along more than one unit of the array. This increases the robustness and flexibility of the FSS device.

According to a third aspect of the present invention, there is provided a method of forming a freestanding FSS, comprising the steps of forming a stiffener layer, forming a polymer layer on a first surface thereof, etching a FSS shorted resonance aperture element shape through the stiffener layer and the polymer layer, etching from underneath the resultant FSS element shape to form a freestanding FSS and metallizing the FSS.

Optionally, the method further comprises the step of forming a polymer layer on a second surface of the stiffener layer, and then etching an FSS shorted resonance aperture element shape through the stiffener layer and both polymer layers.

Optionally, the method further comprises the step of trenching the stiffener and/or the or each polymer layer to form tiles.

Optionally, the polymer of the or each polymer layer is polyimide or BCB.

Optionally, the stiffener layer is formed from a semiconductor material.

Embodiments of the present invention will now be described, by way of example only, with reference to the accompanying drawings, in which:

FIGS. 1*a* and 1*b* illustrate a known FSS and the operation thereof;

FIGS. 2*a* and 2*b* show a transmission response for a prior art FSS;

FIGS. 3*a* to 3*f* show the form and arrangement of resonant elements according to the present invention;

FIG. 3*g* illustrates electric field vector combinations at normal incidence, where theta is the incident angle; 0° is shown;

A resonant FSS element that comprises a continuous annular slot resonates when the circumference of the slot is approximately equal to the wavelength λ of incident radiation, and also to harmonics of λ. A typical frequency response is shown in FIG. 2. At the resonant frequency, the element transmits and the passband width is dependent on the incident angle, separation between the elements, the number of layers, the slot width and depth of each array.

Figure 2A:
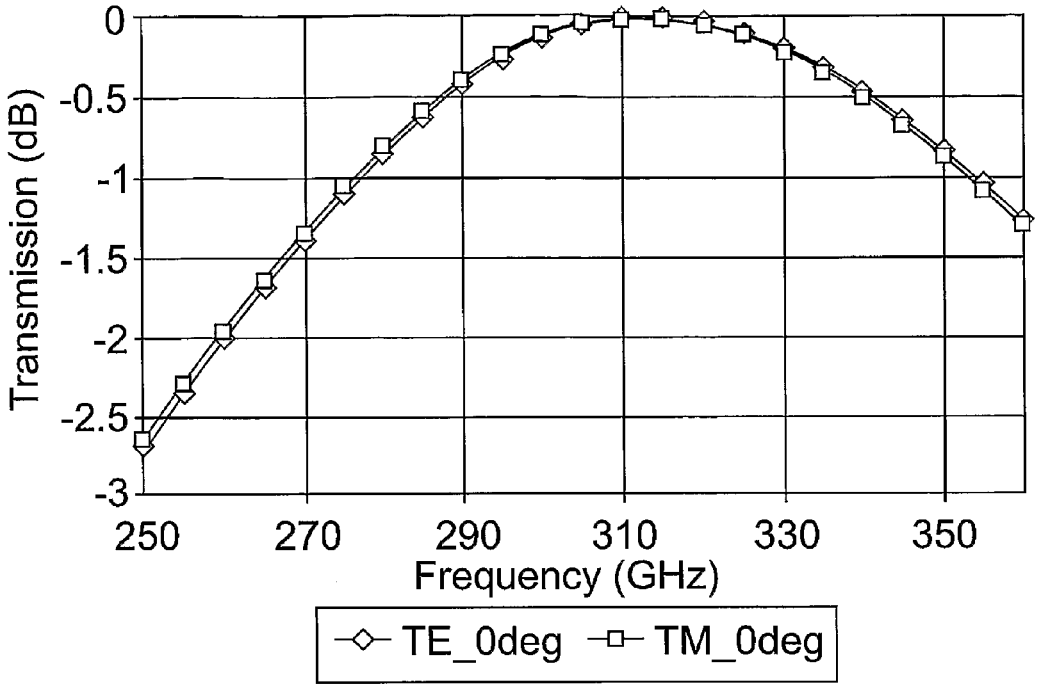

FIG. 2*a* shows the transmission response at normal incidence. It can be seen that in this case, the filter response of the annular slot is independent of the polarization of the incident radiation. It can be seen that the two plots for transverse electric (TE) and transverse magnetic (TM) radiation coincide.

Figure 2B:
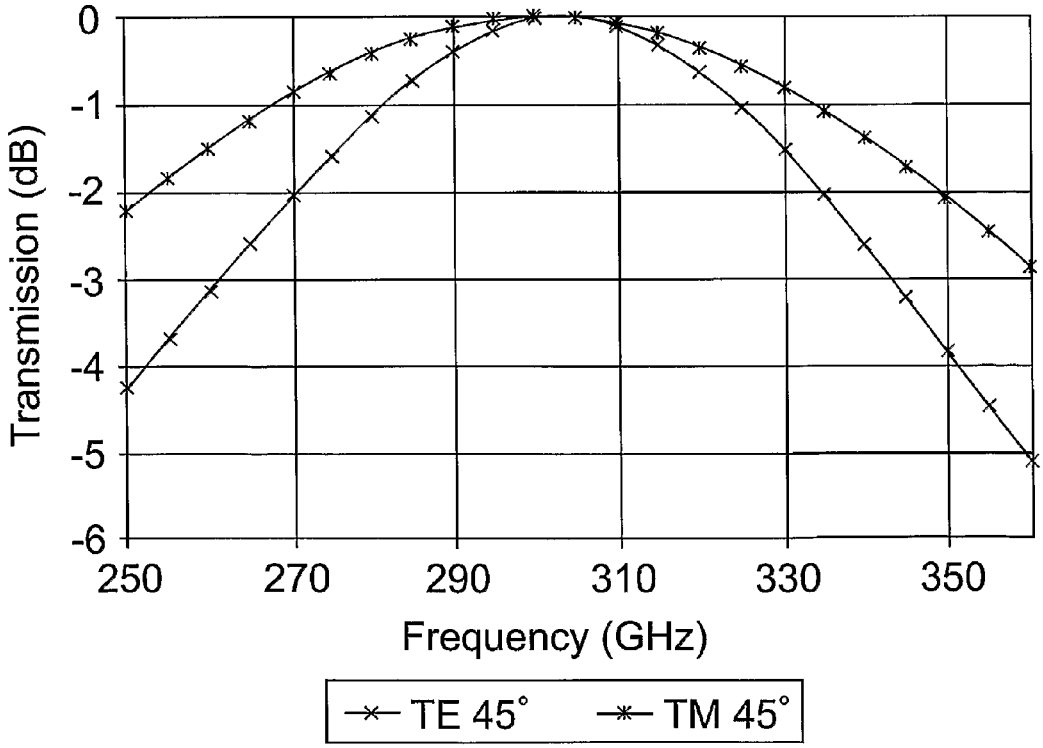

However, at oblique incidence the filter resonance and passband shape differs for the two polarizations as shown in FIG. 2*b*. This is not easily controlled i.e. it is generally not possible to overlay the resonant frequencies.

A continuous annular slot element shape is suitable for existing substrate based technology but cannot be formed into a freestanding FSS, since the inner disk is not supported.

However, by splitting the slot, different magnetic current modes can be excited in the element and the mode depends on the orientation of the electric vector in relation to the slot short and the size of the element in relation to the resonant wavelength. This polarization selectivity enables the frequency selective beamsplitting properties of the device to be controlled independently in orthogonal planes of incidence (TE and TM plane), see FIG. 4, which shows a typical transmission response for nested shorted annular slots for TE and TM 45° incident waves. In addition, this permits the combination or separation of circularly polarized waves or closely spaced channel demultiplexing of linearly polarized waves.

Figure 3A:
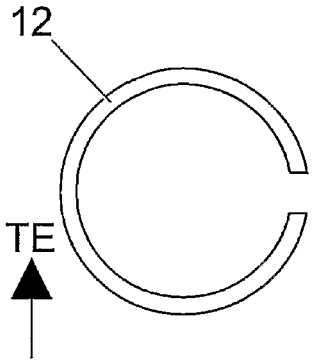
Figure 3B:
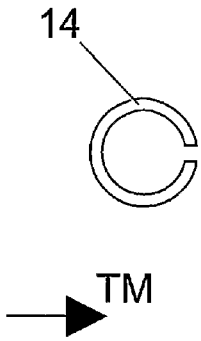
Figure 3C:
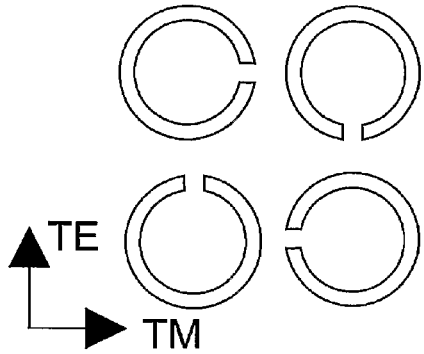
Figure 3D:
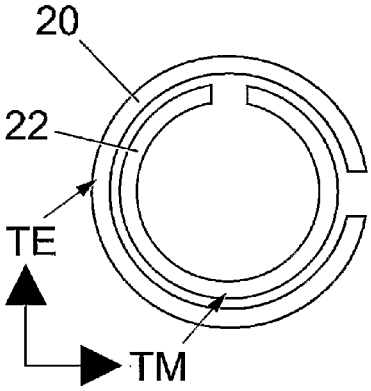
Figure 3E:
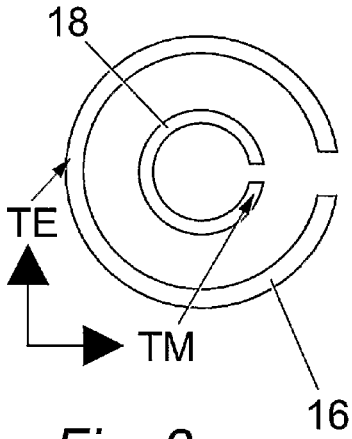
Figure 3F:
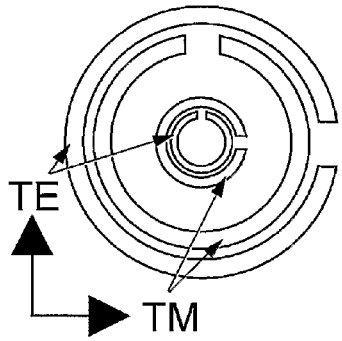

The short also provides support for the inner disk allowing the annular slot shape to be used in the freestanding FSS, as shown in FIGS. 3*d*, 3*e*, and 3*f*.

FIGS. 3*a* to 3*f* show the form and arrangement of FSS resonant elements according to the present invention.

Figure 4A:
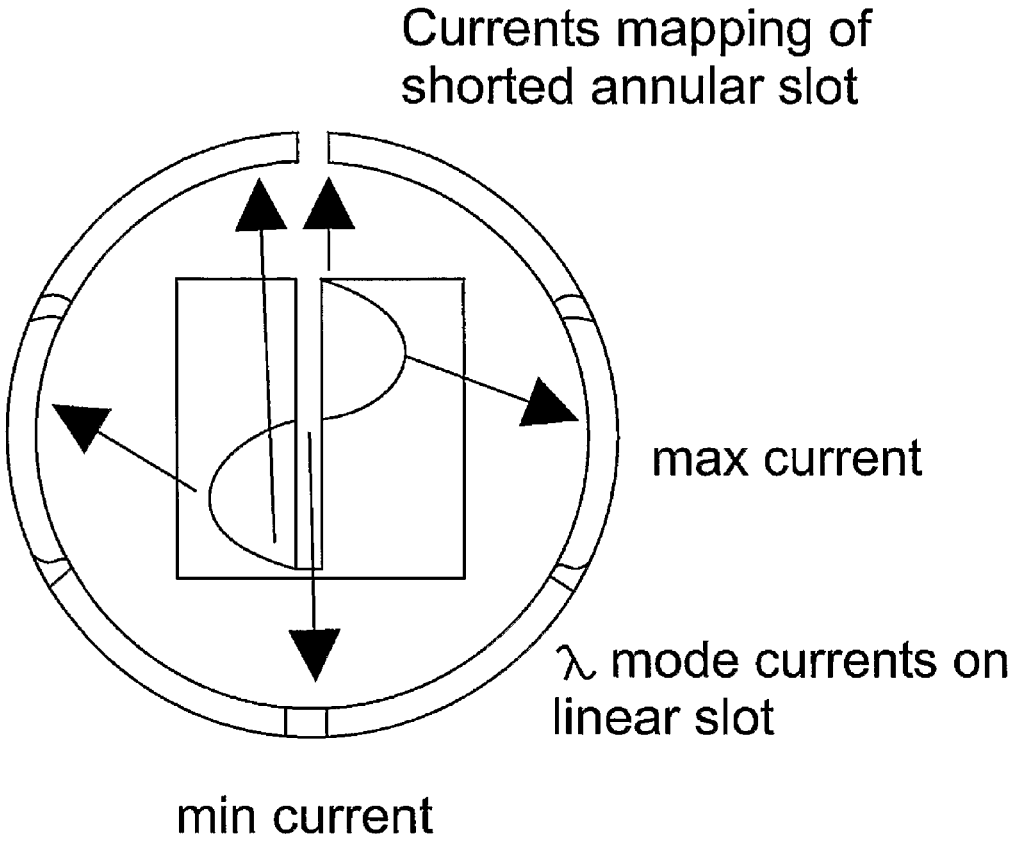
FIG. 4 shows the currents for the modes illustrated in FIG. 3.
Figure 4B:
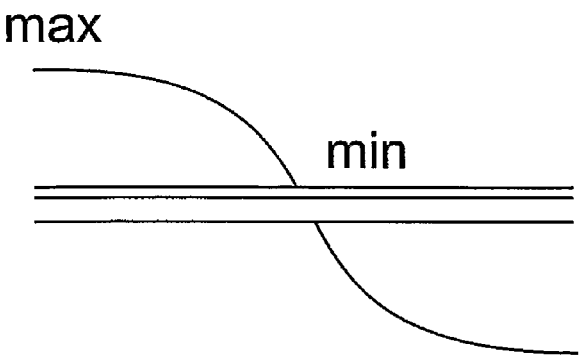
Figure 5:
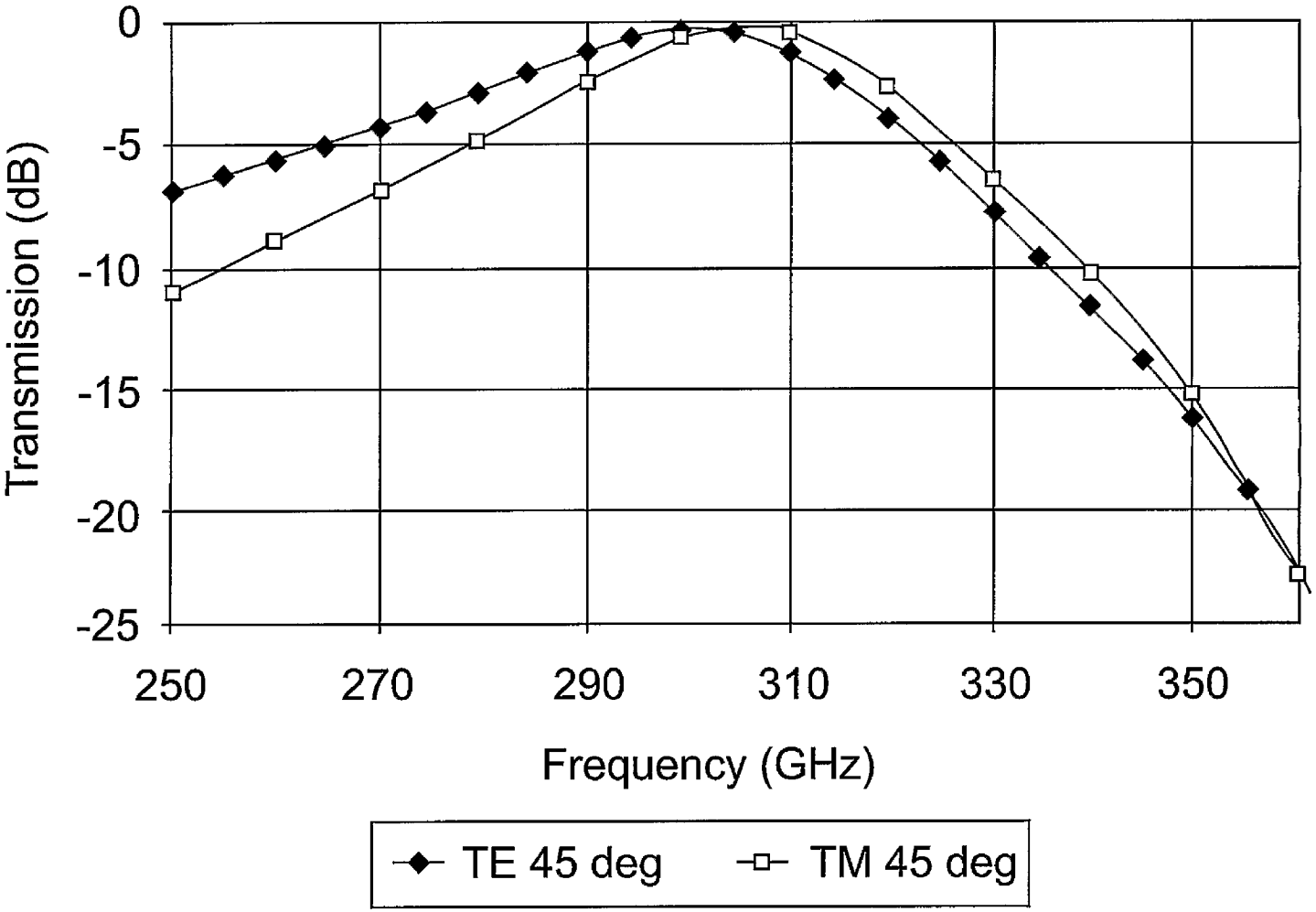
FIG. 5 shows the transmission response of an FSS for a TE and TM 45° incident wave according to an embodiment of the invention.

In FIGS. 3*a* and 3*b*, the conditions necessary to excite a slot 12 in λ (wavelength) and a slot 14 in λ/2 (half-wavelength) modes are shown. The currents for the different modes are shown in FIG. 4, wherein FIG. 4*a* shows a comparison of currents on a λ mode linear slot (insert) and shorted annular slot, and FIG. 4*b* shows currents on a λ/2 linear mode linear slot which can be similarly mapped onto a λ/2 annular slot. At higher frequencies further modes can be generated such as nλ (where n is 1, 2, 4, . . . ) and nλ/2 (where n is 1, 3, 5, . . . ). A "direction" of the shorted gap in the slot can be considered as a direction tangential to the annular slot taken from a central point of the gap. The λ or nλ mode is excited when the electric vector (E) is orientated parallel to the metal short, and when the electric vector is orientated perpendicular to the shorted gap, the λ/2 or nλ/2 mode is excited. Therefore for a given ring diameter the ratio of the resonant frequencies for λ TE and λ/2 TM radiation is 2:1.

By nesting two similarly orientated rings 16, 18 as shown for example in FIG. 3*e* and reducing the physical size of the inner slot 18 (approximately 50% reduction in the circumference relative to the outer ring at normal incidence), it is possible to excite resonances at the same frequency in both rings. In FIG. 3*e*, the TE electric field vector excites the outer wavelength ring 16, and the TM electric field vector excites the inner half-wavelength ring 18. This means the filter response in the two orthogonal planes (i.e. TE and TM incident radiation) can be independently controlled by varying the relative diameter and short length of the two annular slots 16, 18.

Figure 1B:
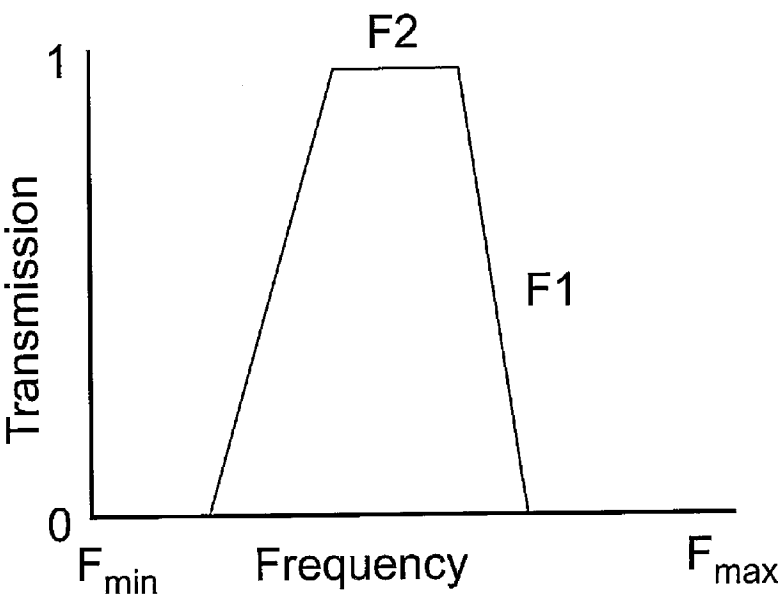
Figure 1A:
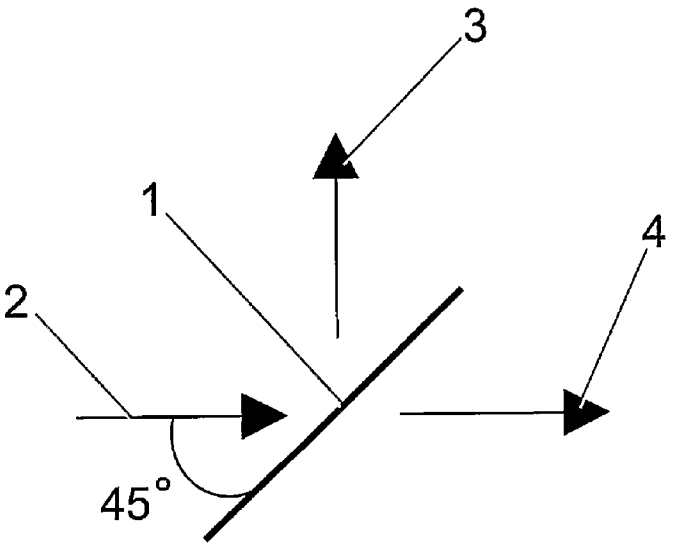

The transition between the transmission band and reflection band is very much faster for an annular slot operating in the λ/2 mode compared to a λ mode annular slot. However when the two annular slots are nested the roll-off response of the λ mode annular slot is increased significantly because the inner ring resonates in the λ mode also but at a higher frequency. This is because the reflection band (F1 in FIG. 1*b*) of λ ring is sandwiched between the transmission peaks which are generated by the inner and outer rings.

Another way to achieve this property is to use nested annular slots 20, 22 which both resonate in the λ mode, as shown in FIG. 3*d*. Here, TE operates the outer λ ring 20 while TM operates inner λ ring 22.

Figure 3G:
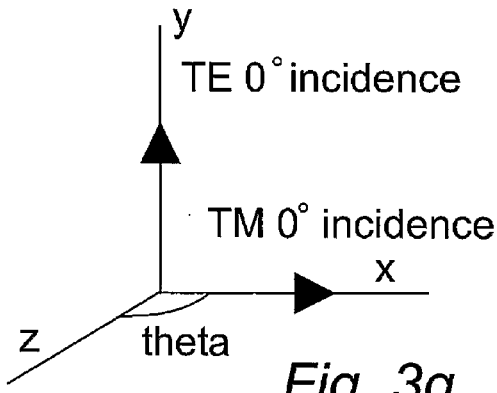

FIG. 3*g* illustrates electric field vector combinations at normal incidence (theta=0°). The incident angle (theta) can be any angle from +90° to −90°.

It is well known that the resonant frequency of a ring FSS which is orientated at oblique incidence is dependent on the orientation of the incident wave, and the difference in the resonant frequency is determined by the physical spacing between the elements. Therefore, by increasing the periodicity of an array of ring FSSs, it is possible to reduce the resonant frequency for one orientation of the electric field. Further in this plane the size of the element can be reduced, to cause it to resonate at the same frequency as the orthogonally polarized wave.

Then, as shown in FIG. 3*d*, by shorting the individual slots and orientating these at 90°, it is possible to independently tune the response of the rings elements which are excited in the λ mode. It is to be noted that the ring also operates for the other polarized wave in the nλ/2 modes.

Also by further nesting λ/2 rings to form a four ring structure, as shown in FIG. 3*f*, it is possible to adjust the roll-off for both outer ring polarizations.

An FSS device according to the present invention uses one, two or more spaced layers of resonant elements. Each layer consists of a thin laminate composite comprising a conductively coated polymer membrane which covers or encapsulates a stiffening portion. The stiffener material used to form the stiffening portion may be silicon or another suitable semiconductor material. Each layer of resonant elements is perforated with an array of apertures, which function as the slots of the FSSs in the array. Examples of possible aperture shapes are shown in FIG. 3.

When the surface of the layers is surrounded by air, i.e. freestanding FSS, dielectric losses are removed and the highest possible beamsplitting efficiency is obtained.

For sub millimeter applications the thickness of the individual layers is typically 10 μm and therefore a prior art solid metal perforated foil structure may not be robust enough to survive situations where the FSS device is subject to large forces, for example, typical launch forces of a space vehicle.

The incorporation of silicon stiffener into a polymer membrane gives the aperture elements good structural rigidity, and, as the polymer membrane prevents cantilever droop of the metal inner part of the slot due to the rigidity of the silicon layer. The polymer membrane is flexible and provides a taut drumskin, and when combined with the rigid stiffener layer gives reduced aperture stretch and distortion when under tensile stress.

The polymer is formed on one or both sides of the silicon tiles, and the slot pattern etched through the laminate. Metal encapsulation then covers the laminate to provide the outer skin on which the resonant currents are formed. The high conductivity electroplated metal on the outer surface, combined with the freestanding FSS provides very efficient frequency filtering.

The polymer used is most preferably polyimide or BCB, although other polymer materials could be used, so long as the choice of material allows deformation under high g force without breaking, and returns to its original shape with little or no deformation.

Silicon is a preferred material as it has sufficient rigidity to support for the inner disk, and also because it can be easily machined to give good dimensional accuracy for the apertures, and also because it has a low coefficient of thermal expansion for good dimensional stability under thermal variation. However, the invention is not limited to the use of silicon, and any other material with similar physical properties could be used, for example, quartz or glass.

Figure 6:
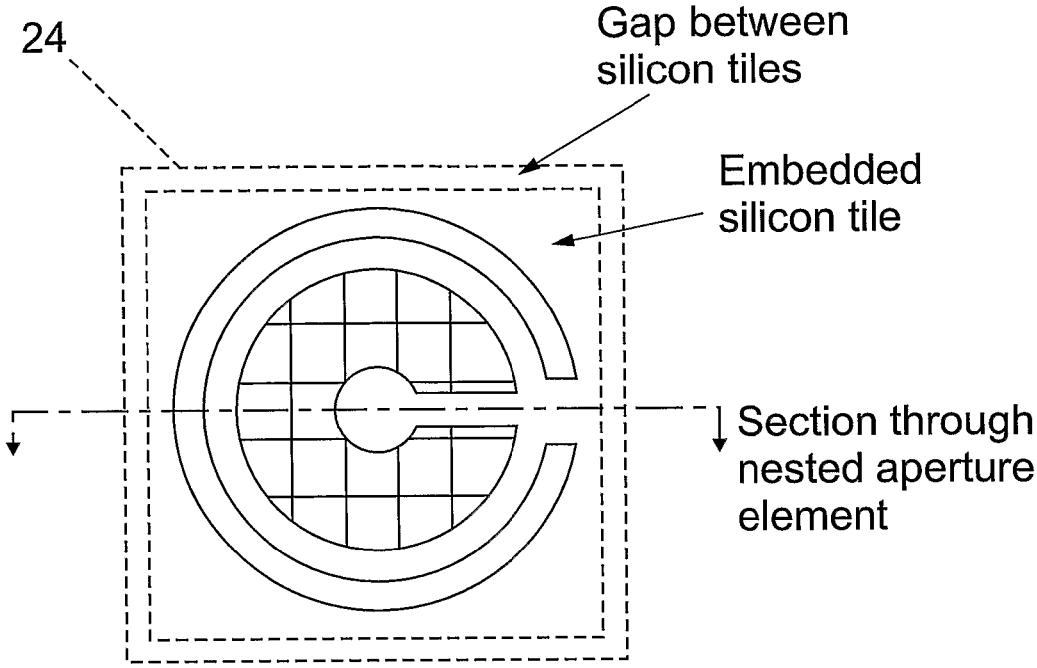
FIG. 6 shows the structure of an FSS layer according to an embodiment of the present invention.
Figure 6:
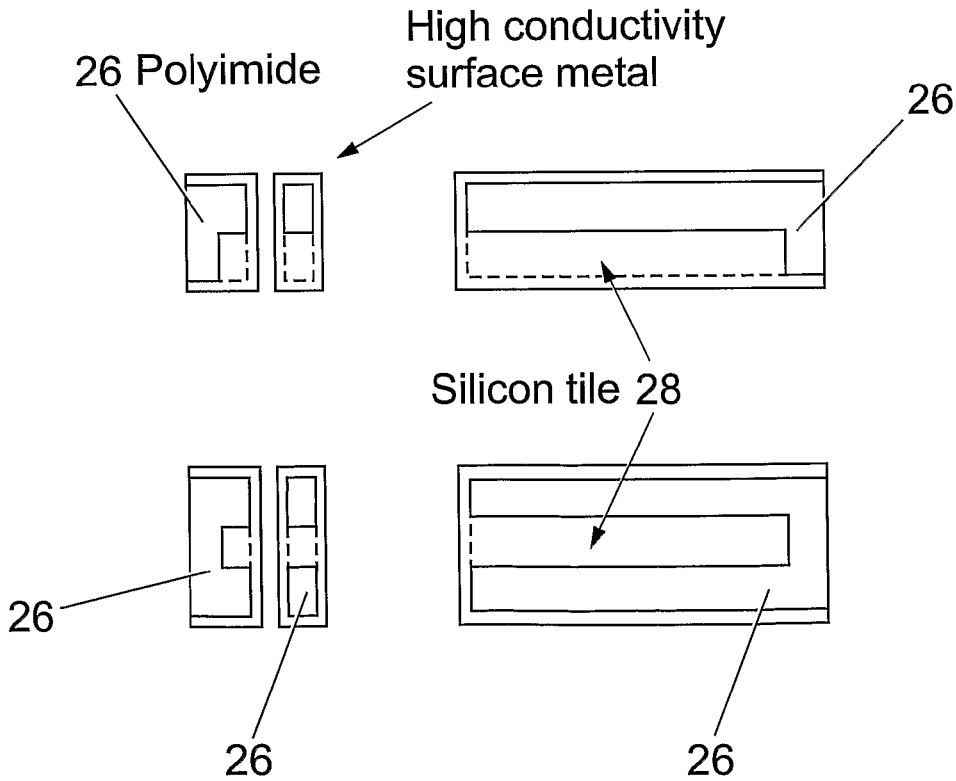

As the silicon is brittle, the silicon wafer can optionally be diced forming an array of tiles. A single tile 24 is shown in FIG. 6, which contains either one slot, multiple slots or more than one nested slots. A layer of polyimide 26 surrounds the tiled silicon wafer 28. The top view of FIG. 6 shows nested aperture rings in a unit cell on the embedded silicon tile, while the lower views show sectional views of two different embodiments—a two layer laminate and a three layer laminate version.

Should a crack form in the silicon during the device's operation life, it will be contained to the silicon tile 24 where it developed, thereby enhancing the robustness of the array and increasing the elasticity of the FSS device.

Figure 7:
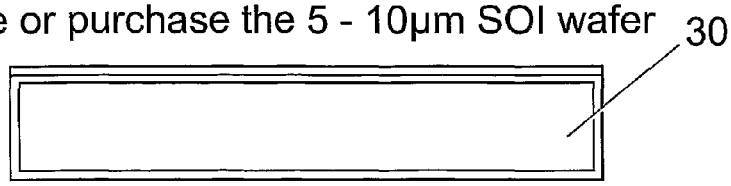
FIG. 7 illustrates a first fabrication technique according to an embodiment of the invention.
Figure 7:
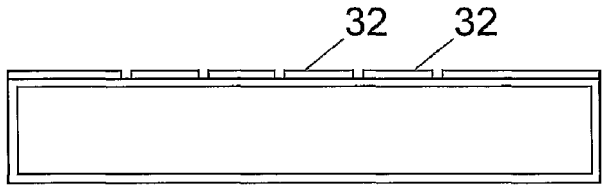
Figure 7:
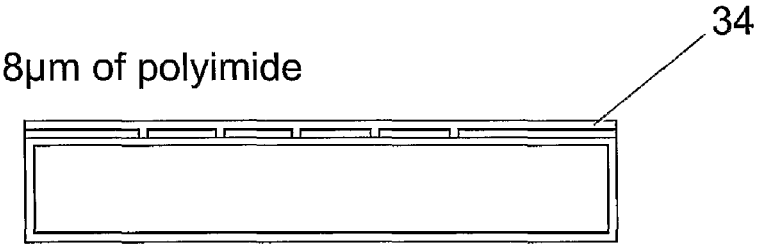
Figure 7:
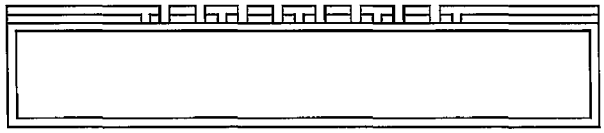
Figure 7:
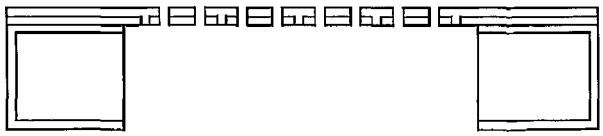
Figure 7:
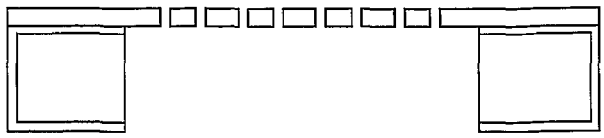

FIG. 7 illustrates one possible manufacturing technique for creating an FSS device according to one embodiment. In step 1, a silicon on insulator (SOI) wafer 30 is purchased or fabricated. This may have any suitable depth, for example a depth from 5 to 10 micrometers. The silicon layer is then trenched to form tiles 32. This trenching step gives the above-mentioned advantages relating to the prevention of crack propagation, but it is an optional step, as the FSS device could be constructed without tiles.

Figure 8:
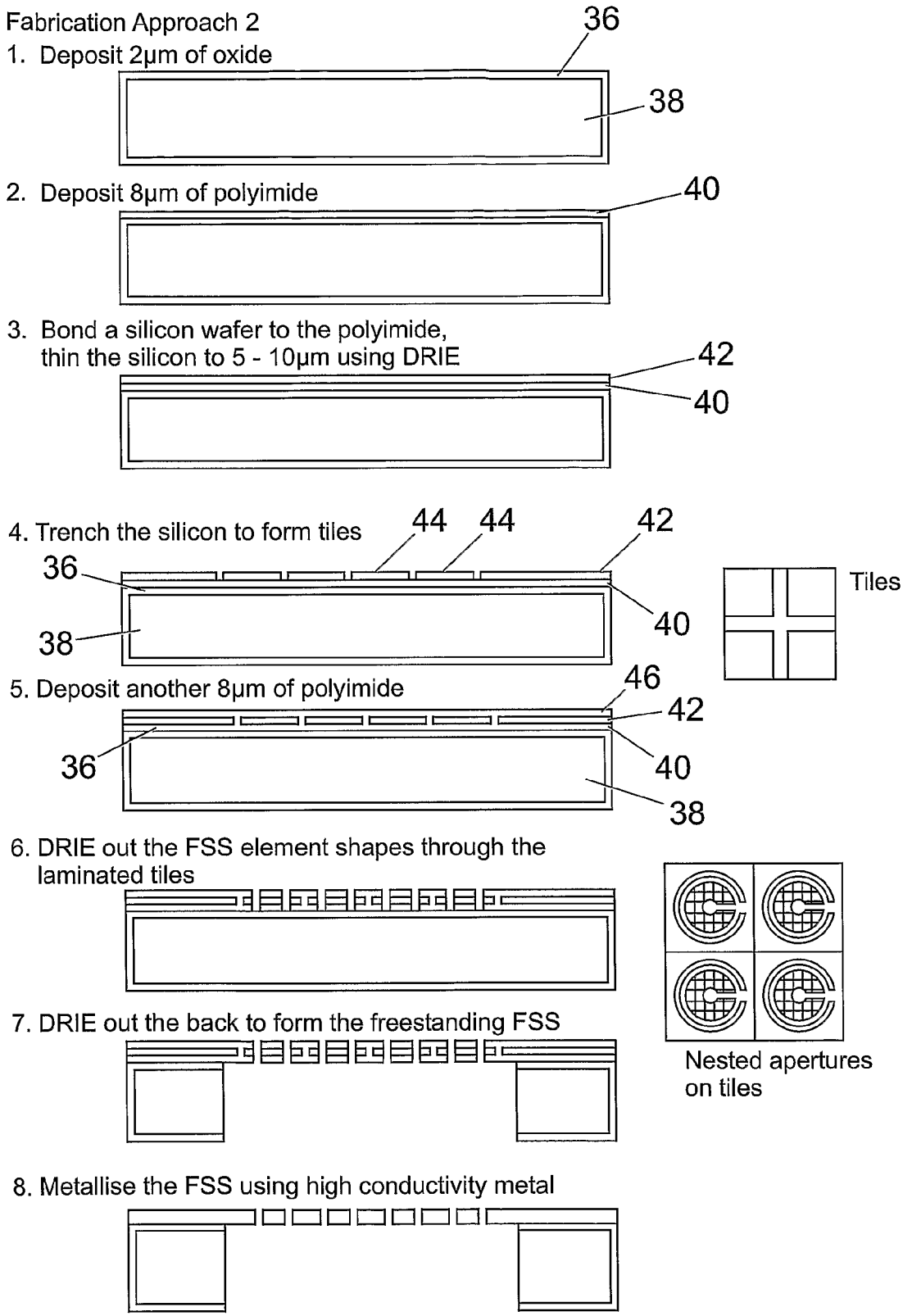
FIG. 8 illustrates a second fabrication technique according to another embodiment of the invention.

A polymer layer 34, most suitably polyimide or BCB is then spun on (it could be deposited by another suitable process), suitably having a thickness of five to fifteen micrometers. The FSS element shape is then etched through the polyimide 34 and trenched silicon layers. The array is then etched from underneath to form the freestanding FSS, before a metallization step is performed. The metallization uses a metal chosen for its conductivity characteristics, for example silver, copper, gold or aluminum or some combination of these. FIG. 8 illustrates one possible manufacturing technique for creating an FSS device according to another embodiment.

A layer of oxide 36 is grown or deposited onto a substrate 38. In a preferred embodiment, the substrate 38 is silicon and the oxide 36 is silicon oxide. An example of a suitable thickness of a layer to be deposited is two micrometers. A polymer layer 40, most suitably polyimide or BCB, is then deposited, following which a silicon wafer 42 is bonded thereto. The silicon wafer 42 is then thinned to a suitable depth, for example a depth from 5 to 10 micrometers. This is achieved for example using Deep Reactive Ion Etching (DRIE).

The silicon layer 42 is then trenched to form tiles 44. This trenching step gives the above-mentioned advantages relating to the prevention of crack propagation, but it is an optional step, as the FSS device could be constructed without tiles 44.

A further layer of polyimide 46 is then deposited, suitably having a thickness of eight micrometers. The FSS element shape is then etched through the top polyimide layer 46, the silicon layer 42, and the bottom polyimide layer 40. The array is then etched from underneath to form the freestanding FSS, before a metallization step is performed. The metallization uses a metal chosen for its conductivity characteristics, for example silver, copper, gold or aluminum or some combination of these.

The methods illustrated in FIGS. 7 and 8 show that very accurate and complex aperture shapes can be manufactured using existing semiconductor processing techniques.

The FSS of the present invention therefore allows a FSS device to be constructed that has many useful advantages over known FSS technology. The FSS device of the present invention can separate or combine two electromagnetic waves over a defined frequency band, with an efficiency factor which is largely independent of the orientation of the impinging linearly polarized waves.

The FSS device can separate or combine an impinging circularly polarized electromagnetic wave, or two linearly polarized orthogonally orientated electromagnetic waves at two different frequencies; and it can generate a circularly polarized wave from a linearly polarized wave which is oriented at either +/−45 degrees to the incident plane.

The metallization of the array, together with the fact that the resonance aperture elements are freestanding, means that the FSS device has very low losses.

Various improvements and modifications may be made to the above without departing from the scope of the invention. For example, while the above embodiments refer to a shorted annular slot, it will be apparent that the invention is equally applicable to other slot shapes, such as rectangular or cross-shaped slots, or squares which may be shorted and therefore form a freestanding FSS according to the invention.

The invention claimed is:

1. A freestanding frequency selective surface (FSS) comprising a plurality of nested resonance aperture elements having at least a first shorted resonance aperture element and a second shorted resonance aperture element nested within the first shorted resonance aperture element, wherein the first shorted resonance aperture element provides a sensitivity to polarization of TE plane polarized incident radiation, and the second shorted resonance aperture element provides a sensitivity to polarization of TM plane polarized incident radiation, the TE and TM incident radiation have substantially the same frequency.

2. A FSS according to claim 1 in which the at least one shorted resonance aperture element comprises at least one short.

3. A FSS according to claim 2 in which the at least one short enables the FSS to be freestanding.

4. A FSS according to claim 1 in which the plurality of nested resonance aperture elements separate or combine two channels of incident radiation which are very closely spaced in the frequency domain.

5. A FSS according to claim 1 in which at least one shorted resonance aperture element is substantially circular.

6. A FSS according to claim 5 in which the at least one circular shorted resonance aperture element comprises a single short in the circle.

7. A FSS according to claim 1 in which at least one shorted resonance aperture element has a composite structure, comprising a stiffener layer bounded on at least one surface thereof by a polymer layer.

8. A FSS according to claim 7 in which the stiffener layer and the polymer layer are encapsulated by a metallization layer.

9. A FSS according to claim 7 in which the stiffener layer is formed from a semiconductor material.

10. A FSS according to claim 9 in which the stiffener layer comprises silicon.

11. A FSS according to claim 7 in which the stiffener layer is bounded on both a first surface and a second surface thereof by a polymer layer.

12. A FSS according to claim 7 in which the polymer layer comprises polyimide or B-staged bisbenzocyclobutene (BCB).

13. An FSS device comprising at least one array of freestanding frequency selective surfaces according to claim 1.

14. An FSS device according to claim 13 in which a plurality of arrays is provided as one or more spaced layers.

15. An FSS device according to claim 13 comprising a tiled structure having a plurality of isolated silicon tiles, at least some of the tiles having at least one FSS shorted resonance aperture element formed therein.

16. An FSS device according to claim 15 in which the tiled structure prevents propagation of cracks along more than one unit of the array.

17. An FSS device comprising at least one array of freestanding selective surfaces according to claim 1.

18. An FSS device comprising at least one array of freestanding selective surfaces according to claim 5.

19. A FSS according to claim 1 in which the sensitivity of the first shorted resonance aperture element to the polarization of the TE plane polarized incident radiation causes excitation of a resonance in the first shorted resonance aperture element and transmission of the TE plane polarized incident radiation, and the sensitivity of the second shorted resonance aperture element to the polarization of the TM plane polarized incident radiation causes excitation of a resonance in the second shorted resonance aperture element and transmission of the TM plane polarized incident radiation.

20. A FSS according to claim 1 in which the first and second shorted resonance aperture elements have relative sizes which provide the polarization sensitivity of the first shorted resonance aperture element to the polarization of the TE plane polarized incident radiation and the polarization sensitivity of the second shorted resonance aperture element to the polarization of the TM plane polarized incident radiation when the TE and TM incident radiation have substantially the same frequency.

21. A FSS according to claim 19 in which the relative size of the first shorted resonance aperture element to the second shorted resonance aperture element is substantially 2:1.

22. A FSS according to claim 1 in which the short of each of the first and second shorted resonance aperture elements is orientated to provide the polarization sensitivity of the first shorted resonance aperture element to the polarization of the TE plane polarized incident radiation and the polarization sensitivity of the second shorted resonance aperture element to the polarization of the TM plane polarized incident radiation when the TE and TM incident radiation have substantially the same frequency.

23. A FSS according to claim 1 in which at least some of the shorted resonance aperture elements are substantially rectangular.

24. A method of forming a freestanding FSS, comprising:

forming a stiffener layer, forming a polymer layer on a first surface thereof, etching a FSS shorted resonance aperture element shape through the stiffener layer and the polymer layer, wherein the FSS shorted resonance aperture element shape comprises a plurality of nested resonance aperture element shapes having at least a first shorted resonance aperture element shape and a second shorted resonance aperture element shape nested within the first shorted resonance aperture element shape, etching from underneath the resultant FSS element shape to form a freestanding FSS comprising a plurality of nested resonance aperture elements having at least a first shorted resonance aperture element and a second shorted resonance aperture element nested within the first shorted resonance aperture element, and metallizing the FSS, wherein the first shorted resonance aperture element provides a sensitivity to polarization of TE plane polarized incident radiation, and the second shorted resonance aperture element provides a sensitivity to polarization of TM plane polarized incident radiation, the TE and TM incident radiation have substantially the same frequency.

25. A method according to claim 24 further comprising:

forming a polymer layer on a second surface of the stiffener layer, and etching the FSS shorted resonance aperture element shape through the stiffener layer and both polymer layers.

26. A method according to claim 24 further comprising trenching the stiffener and/or the polymer layer to form tiles.

27. A method according to claim 24 further comprising forming the polymer layer from polyimide or BCB.

28. A method according to claim 24 further comprising forming the stiffener layer from a semiconductor material.

* * * * *

UNITED STATES PATENT AND TRADEMARK OFFICE

CERTIFICATE OF CORRECTION

PATENT NO. : 7,982,686 B2
APPLICATION NO. : 11/908678
DATED : July 19, 2011
INVENTOR(S) : Robert Cahill et al.

It is certified that error appears in the above-identified patent and that said Letters Patent is hereby corrected as shown below:

Title Page, item (75) should read:

Inventors: Robert Cahill, Jordanstown (GB);
Raymond John Dickie, Belfast (GB);
Vincent Francis Fusco, Glengormley (GB);
Harold Samuel Gamble, Dromore (GB)

Signed and Sealed this
Thirteenth Day of December, 2011

David J. Kappos

David J. Kappos
*Director of the United States Patent and Trademark Office*